US009002229B2

(12) United States Patent
Takami

(10) Patent No.: US 9,002,229 B2
(45) Date of Patent: Apr. 7, 2015

(54) IMAGE FORMING APPARATUS

(75) Inventor: Hiroshi Takami, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 233 days.

(21) Appl. No.: 13/567,767

(22) Filed: Aug. 6, 2012

(65) Prior Publication Data

US 2013/0039674 A1 Feb. 14, 2013

(30) Foreign Application Priority Data

Aug. 10, 2011 (JP) ..... 2011-175001

(51) Int. Cl.
*G03G 15/20* (2006.01)

(52) U.S. Cl.
CPC ..... *G03G 15/2017* (2013.01); *G03G 15/2042* (2013.01); *G03G 2215/2035* (2013.01)

(58) Field of Classification Search
CPC ..... G03G 15/2039; G03G 15/20
USPC ..... 399/69, 68; 219/216
See application file for complete search history.

(56) References Cited

U.S. PATENT DOCUMENTS 5,550,621 A * 8/1996 Ogawahara ..... 399/69
6,724,999 B2 * 4/2004 Kikuchi et al. ..... 399/69
7,421,219 B2 * 9/2008 Matsuura et al. ..... 399/68
7,542,692 B2 * 6/2009 Yamamoto et al. ..... 399/69
7,580,649 B2 * 8/2009 Takagi et al. ..... 399/69
7,792,449 B2 * 9/2010 Kurokawa ..... 399/69
2009/0208229 A1 * 8/2009 Takagi et al.
2012/0308256 A1 * 12/2012 Suzuki
2013/0108299 A1 * 5/2013 Minagawa et al. ..... 399/69
2013/0142536 A1 * 6/2013 Takami ..... 399/69

FOREIGN PATENT DOCUMENTS

JP 4-51179 A 2/1992
JP 2003-076209 A 3/2003

* cited by examiner

*Primary Examiner* — Susan Lee
(74) *Attorney, Agent, or Firm* — Canon USA Inc IP Division

(57) ABSTRACT

An image forming apparatus includes a fixing unit, wherein the fixing unit includes a first temperature detection member detecting the temperature of a first non-passing area of the fixing unit; a second temperature detection member detecting the temperature of a second non-passing area; and a cooling unit supplying air so as to simultaneously cool the first non-passing area and the second non-passing area, wherein the image forming apparatus is configured, when the absolute value of the difference between the detection temperature of the temperature detection members becomes not less than a threshold value, while air is being supplied to the non-passing area and the second non-passing area, to stop the supplying of air by the cooling unit and continue recording material fixing processing.

10 Claims, 13 Drawing Sheets

FIG. 6

| RECORDING MATERIAL | SUB HEATER DRIVE RATIO |
|---|---|
| GROUP A | 100% |
| GROUP B | 50% |
| GROUP C | 0% |

FIG. 10

| RECORDING SHEET | AIR SUPPLYING FAN | SHUTTER POSITION |
|---|---|---|
| GROUP A | OFF | POSITION X |
| GROUP B | ON | POSITION X |
| GROUP C | ON | POSITION Y |

RECORDING MATERIAL CONVEYANCE
REFERENCE POSITION (CENTER)

M

IMAGE FORMING APPARATUS

BACKGROUND OF THE INVENTION

1. Field of the Invention

The present invention relates to an image forming apparatus employing electrophotographic system such as a copying machine or a printer.

2. Description of the Related Art

In an image forming apparatus employing electrophotographic system as a fixing unit for fixing an unfixed toner image to a recording material, a heat roller type and a film fixing type is widely used.

In the above-described fixing unit, when small-sized recording materials whose width is smaller than that of a recording material of a maximum width which the apparatus can convey, are to be successively conveyed, there is a problem called non-passing part temperature rise, in which the temperature of the non-passing area of the fixing member excessively increases.

As a countermeasure against the problem, Japanese Patent Application Laid-Open No. 4-51179 discusses a fixing unit in which cooling air is selectively supplied to the non-passing areas at both end portions of the fixing unit from an air supplying fan arranged in the fixing unit.

Further, Japanese Patent Application Laid-Open No. 2003-076209 discusses a fixing unit in which when supplying cooling air to the non-passing areas from the air supplying fan, the length in the width direction of the air supplying fan outlet is adjusted according to the width of the recording material in a direction orthogonal to the recording material conveyance direction, whereby it is possible to prevent an increase in temperature in the non-passing parts even in the case of recording materials differing in the above described width.

However, in the case of the fixing unit in which a cooling system to supply air to the non-passing areas of the fixing unit by providing the above-described air supplying fan is mounted, the following problems are involved.

First, the sheet is conveyed while being deviated with respect to a conveyance reference position in a direction orthogonal to the recording material conveyance direction. When above described deviated sheet-passing occurs, an image defect is generated at the edge portions of the recording material in the direction orthogonal to the recording material conveyance direction. FIGS. 13A and 13B are diagrams illustrating the positional relationship between the recording material and the fixing unit in which the above-described cooling system is mounted. FIG. 13A illustrates the state in which the recording material is conveyed at conveyance reference position. The diagram illustrates a recording material 2001, a film 2004, and air supplying fans 2002 and 2003. The recording material 2001 is conveyed such that a broken line M extending through the central portion of the film 2004 becomes a conveyance reference position. In the film 2004, non-passing part temperature rise occurs in areas G and H where the recording material 2001 does not pass. By supplying air to the areas G and H by the air supplying fans 2002 and 2003, respectively, it is possible to suppress the non-passing part temperature rise.

On the other hand, FIG. 13B illustrates a deviated sheet-passing state, in which the recording material is conveyed while being deviated from the conveyance reference position. Suppose the recording material 2001 is conveyed while being deviated in the direction close to the air supplying fan 2002 and orthogonal to the recording material conveyance direction. Non-passing part temperature rise occurs in an area I and an area K+H. The problem with this situation is that the recording material 2001 passes an area J which is cooled by the air supplying fan 2002, so that the area J does not reach a temperature enough to fix the toner to the recording material, resulting, in some cases, in occurrence of defective fixing. Further, although the area K is an area where non-passing part temperature rise occurs, no cooling air is supplied thereto, so that the temperature rise ratio is higher than in the other areas. Thus, it can be seen that when air is supplied by the air supplying fan at the time of generation of deviated sheet-passing, the difference in temperature between the area J and the area K increases as compared with the case where no air is supplied. In particular, in the case of the film fixing type, when an unsymmetrical temperature distribution is generated in the film, the thermal expansion amount of the pressure roller is also unsymmetrical. As a result, the difference in conveyance force between both end portions of the film in the direction orthogonal to the recording material conveyance direction is also large, resulting in occurrence of deviation of the film. As a result, the end portions of the film reach fracture in some cases.

Second, in the case where imbalance in the amount of air supplied to both end portions of the film is generated due to abnormal operation of the cooling system, the end portions of the film can reach fracture for the same reason as described above. Such imbalance in the amount of air supplied to both end portions occurs, for example, due to deterioration in the characteristics of the air supplying fans individually provided at both end portions of the film.

SUMMARY OF THE INVENTION

The present invention is directed to an image forming apparatus capable of preventing generation of defective fixing at the time of unbalanced sheet-passing when cooling the non-passing areas by air supplied from air supplying fans, and fracture of the end portions of the fixing member due to deviation of the fixing member.

According to an aspect of the present invention, an image forming apparatus configured to form an image on a recording material includes a fixing unit configured to heat the recording material bearing a toner image to fix the toner image onto the recording material while conveying the recording material bearing the toner image by a nip portion, wherein the fixing unit includes a fixing member and a pressure member configured to form the nip portion by coming into contact with the fixing member, a first temperature detection member configured to detect a temperature of a first non-passing area which is situated at one end portion of the fixing unit in a direction orthogonal to a recording material conveyance direction and where a small size recording material of a width smaller than that of a recording material of a maximum width which the image forming apparatus can convey does not pass, a second temperature detection member configured to detect a temperature of a second non-passing area which is situated at an end portion of the fixing unit on a side opposite the end portion where the first non-passing area exists, and a cooling unit configured to supply air so as to simultaneously cool the first non-passing area and the second non-passing area, wherein the image forming apparatus is configured, when an absolute value of a difference between the detection temperature of the first temperature detection member and the detection temperature of the second temperature detection member becomes not less than a threshold value, while air is being supplied to the first non-passing area and the second non-passing area by the cooling unit with the small size recording material being conveyed by the nip portion, to stop the supplying of air by the cooling unit and continue recording material fixing processing.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

FIG. 6 is a diagram illustrating the relationship between the width of the recording material and the driving ratio of a sub heater according to the first exemplary embodiment.

FIG. 10 is a diagram illustrating the relationship among the width of the recording material, the turning ON/OFF of the operation of the air supplying fan, and the shutter position according to the first exemplary embodiment.

DESCRIPTION OF THE EMBODIMENTS

Various exemplary embodiments, features, and aspects of the invention will be described in detail below with reference to the drawings.

Figure 1:
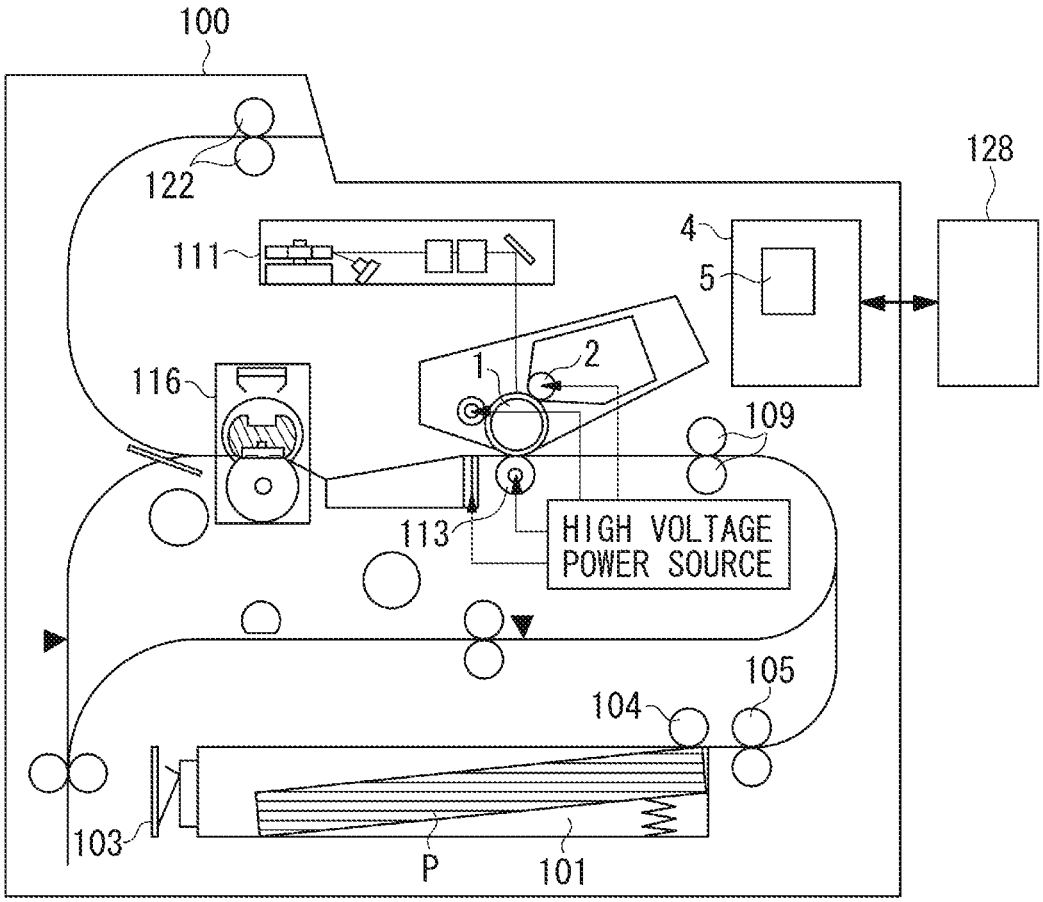
FIG. 1 is a diagram schematically illustrating an image forming apparatus according to a first exemplary embodiment.

In the following, a first exemplary embodiment of the present invention will be described with reference to the drawings. FIG. 1 is a schematic diagram illustrating a laser beam printer 100 according to the first exemplary embodiment. A recording material P is accommodated in a cassette 101, and the sheet size of the recording material P is detected by a sheet size detection sensor 103 provided within the cassette 101. The recording material P, which is drawn out by a pickup roller 104, is conveyed to a registration roller pair 109 by a sheet feeding roller 105. A laser scanner unit 111 performs scanning on a photosensitive drum 1 based on image information from a video controller 128 to forma latent image on the photosensitive drum 1. The latent image formed on the photosensitive drum 1 is developed by a developing roller 2 to be turned into a toner image.

After this, the recording material P is conveyed to a transfer nip portion formed by the photosensitive drum 1 and a transfer roller 113 in synchronization with a toner image formed on the photosensitive drum 1, and an unfixed toner image is transferred onto the recording material P. The recording material P to which the unfixed toner image has been transferred undergoes fixing of the unfixed toner image thereto at a fixing unit 116. The recording material P having undergone the fixing is discharged by a discharge roller pair 122. A series of control operations of the present image forming apparatus are performed by a central processing unit (CPU) mounted in an engine controller 4. A non-transitory computer readable medium may be encoded with instructions that are performed by the CPU.

Figure 2:
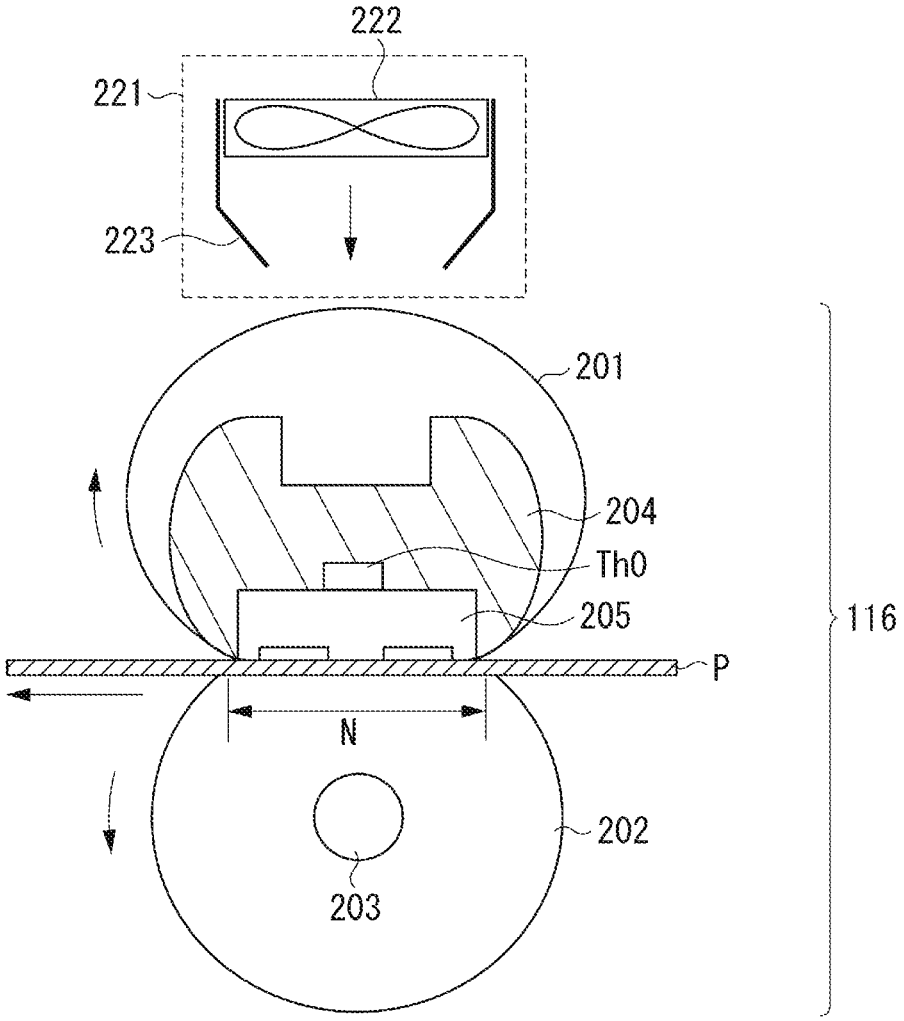
FIG. 2 schematically illustrates a fixing unit and an air supplying member according to the first exemplary embodiment.

FIG. 2 is a schematic diagram illustrating the fixing unit 116. The fixing unit 116 is a film heating type fixing unit. As a fixing member, a tubular film 201 is provided. The film 201 is a single-layer film of polyimide or the like having a thickness of approximately 40 to 100 μm, or a composite-layer film formed by coating the outer peripheral surface of a polyimide film with perfluoroalkoxy or the like. The fixing unit 116 includes a ceramic heater 205 (hereinafter referred to as the heater), which comes into contact with the inner surface of the film 201 to heat the film 201.

The fixing unit 116 includes a film guide 204 configured to hold the heater 205 and guide the film inner surface. The fixing unit 116 also includes a pressure roller 202 as a pressure member, which is an elastic roller formed by providing a heat resistant elastic layer of silicone rubber or the like in the outer periphery of a core 203. The pressure roller 202 forms a nip portion N together with the heater 205 sandwiching the film 201. The pressure roller 202 is driven by a motor (not illustrated) to rotate counterclockwise as seen in FIG. 2. The film 201 rotates clockwise by driven by the pressure roller 202 at the nip portion N. The recording material P bearing the toner image is heated while being conveyed through the nip portion N, whereby the toner image is fixed to the recording material.

The fixing unit 116 also includes cooling units 221 configured to suppress non-passing part temperature rise in the film 201. The fixing unit also includes an air supplying fan 222 as an air supplying member. Cooling air generated by the air supplying fan is guided toward the film 201 via a duct 223 to cool the non-passing areas of the film 201. The cooling units 221 are respectively provided at both end portions of the heater 205 in a direction orthogonal to the recording material conveyance direction. The construction of the cooling units will be described in detail below. The target of supplying air by the air supplying fan is not restricted to the film 201. It may also be the pressure roller 202.

Figure 3:
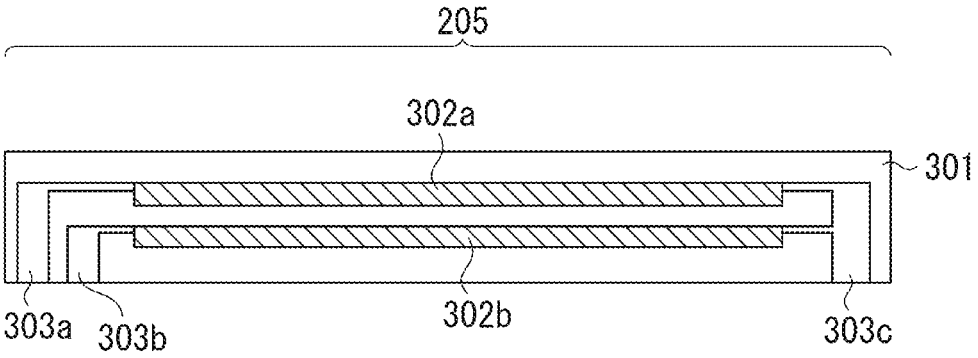
FIG. 3 is a diagram illustrating the construction of a heater according to the first exemplary embodiment.
Figure 4:
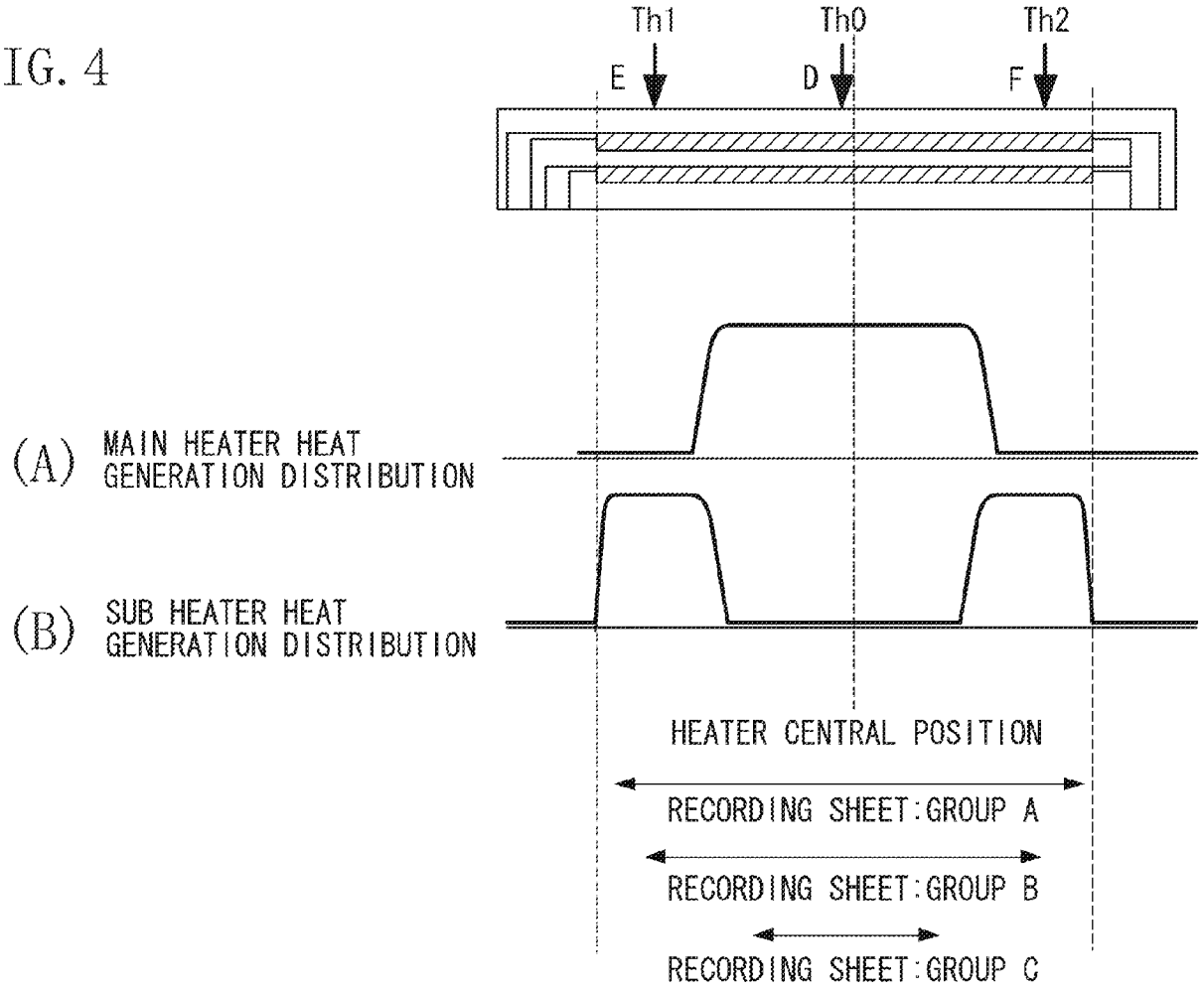
FIG. 4 is a diagram illustrating the relationship between the heat generation distribution and the width of a recording material according to the first exemplary embodiment.

Next, FIG. 3 is a schematic diagram illustrating the construction of the heater 205. The heater 205 is arranged so as to be elongated in a direction orthogonal to the recording material conveyance direction. The heater 205 employs alumina ($Al_2O_3$) as a base material. On one side thereof, two heat generation resistors 302*a* and 302*b* are formed by printing. The heat generation resistors 302*a* and 302*b* are covered with a glass protective layer as an electrical insulation layer. In the first exemplary embodiment, the heater portion formed by the heat generation resistor 302*a* is referred to as a main heater 302*a*, and the heater portion formed by the heat generation resistor 302*b* is referred to as a sub heater 302*b*. Power supply electrodes 303*a*, 303*b*, 303*c* are formed so as to be capable of applying voltage to both ends of the heat generation resistors. The two heaters, i.e., the main heater 302*a* and the sub heater 302*b*, differ from each other in heat generation distribution. FIG. 4 is a diagram illustrating the relationship among the heat generation distributions of the main heater 302*a* and the sub heater 302*b*, the width of the recording material in the direction orthogonal to the recording material conveyance direction, and the position of a temperature detection member (thermistor). In the main heater 302*a*, the heat generation amount is larger at the central portion than at the end portions in the direction orthogonal to the recording material conveyance direction. On the other hand, in the sub heater 301*b*, the heat generation amount is larger at the end portions in the direction orthogonal to the recording material conveyance direction than at the central portion.

The temperature detection unit for detecting the temperature of the heater 205 includes three thermistors as temperature detection members. Each thermistor is pressed against the heater 205 with a predetermined pressure. The arrangement of the above thermistors will be illustrated with reference to FIG. 4. The three thermistors are arranged on the heater 205 as indicated by arrows D, E, and F. A thermistor Th0 is arranged at the central portion D of the heater 205. A thermistor Th1 as the first temperature detection member is arranged at a first non-passing area E which is at an end portion of the heater 205 in the direction orthogonal to the recording material conveyance direction and which constitutes a non-passing area when a small size recording material of a width smaller than the maximum width which the image forming apparatus can convey. A thermistor Th2 as the second temperature detection member is arranged at an end portion of the heater 205 on the side opposite the non-passing area where the first temperature detection member performs temperature detection and in a second non-passing area F constituting the above non-passing area. The outputs of the thermistors are input to a CPU 5 via respective temperature detection circuits (not illustrated). Although in the present exemplary embodiment the first temperature detection member and the second temperature detection member detect the temperature of the heater 205, they may also detect the temperature of the film 201 and of the pressure roller 202.

Figure 5:
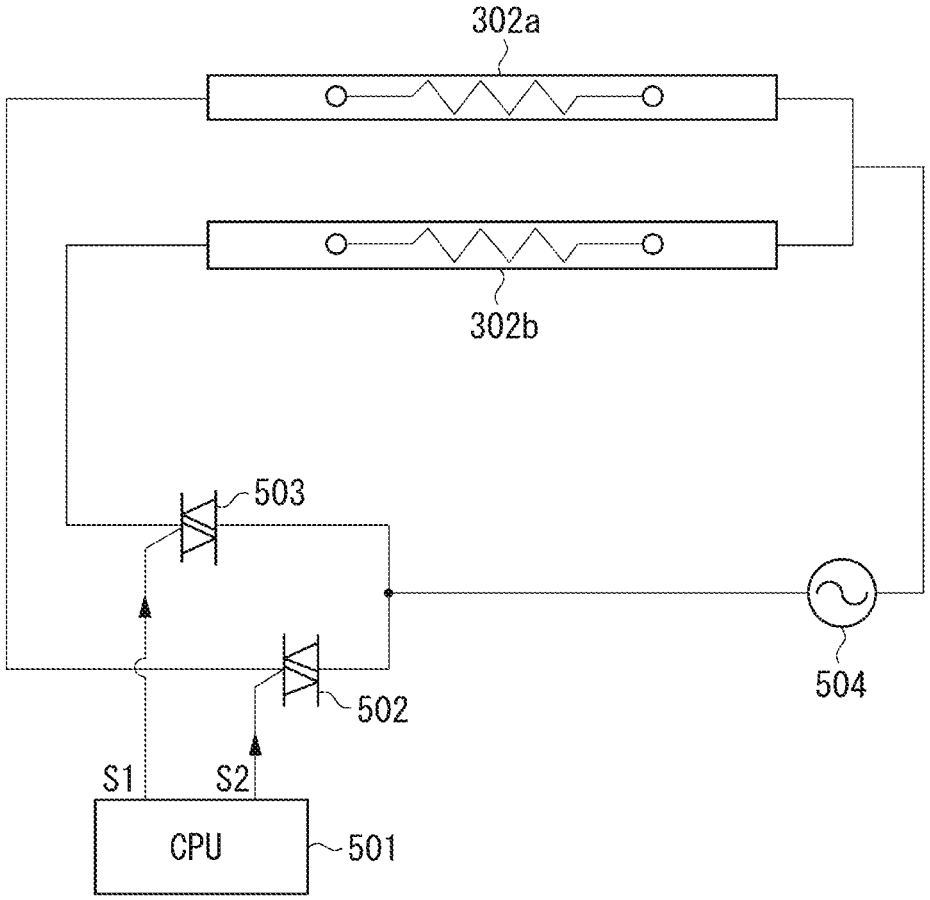
FIG. 5 is a diagram schematically illustrating a heater drive circuit according to the first exemplary embodiment.

Next, a power control circuit for supplying power to the heater 205 will be described. The power supply amounts to the main heater 302*a* and to the sub heater 302*b* can be controlled independently of each other. FIG. 5 illustrates the connection in the power supply control circuit. The circuit includes a CPU 501, first and second triacs 502 and 503, and an alternate current (AC) power source 504. The first triac 502 and the main heater 302*a* are connected in series, and the second triac 503 and the sub heater 302*b* are also connected in series. They are connected in parallel to the AC power source 504. The triacs 502 and 503 are turned on and off respectively by a first heater drive signal S1 and a second heater drive signal S2 from the CPU 501. Based on the detection result of the thermistor Th0, the first heater drive signal S1 and the second heater drive signal S2 are ON/OFF-controlled, enabling the heater 205 to be controlled to a target temperature. In the first exemplary embodiment, control is performed so as to set the detection temperature of the thermistor Th0 to 200° C.

In the image forming apparatus according to the first exemplary embodiment, the drive ratios of the first and second heaters are determined according to the width of the recording material. FIG. 6 is a table illustrating the drive ratio of the sub heater 302*b*. As illustrated in FIG. 4, in the first exemplary embodiment, the recording materials are classified into three kinds: group A, group B, and group C depending on differences in recording material width. The sub heater 302*b* is driven at a drive ratio according to group A, group B, and group C differing in recording material width. FIG. 4 illustrates how the recording materials are classified into group A, group B, and group C. For example, the recording material of group A is a recording material of a maximum size (maximum width) which the apparatus can convey. It is a recording material whose width is substantially equal to the width of the heater 302. The recording materials of groups B and C are recording materials whose width is smaller than that of the recording material of group A. In the case of the recording material of group A, when the sub heater 302*b* is driven at a drive ratio equal to that of the main heater 302*a*, the heat generation distribution in the direction orthogonal to the recording material conveyance direction is substantially equal to the width of the recording material. In this way, by determining the drive ratios of the main heater and of the sub heater according to the width of the recording material in the direction orthogonal to the recording material conveyance direction, it is possible to suppress non-passing part temperature rise.

Figure 7:
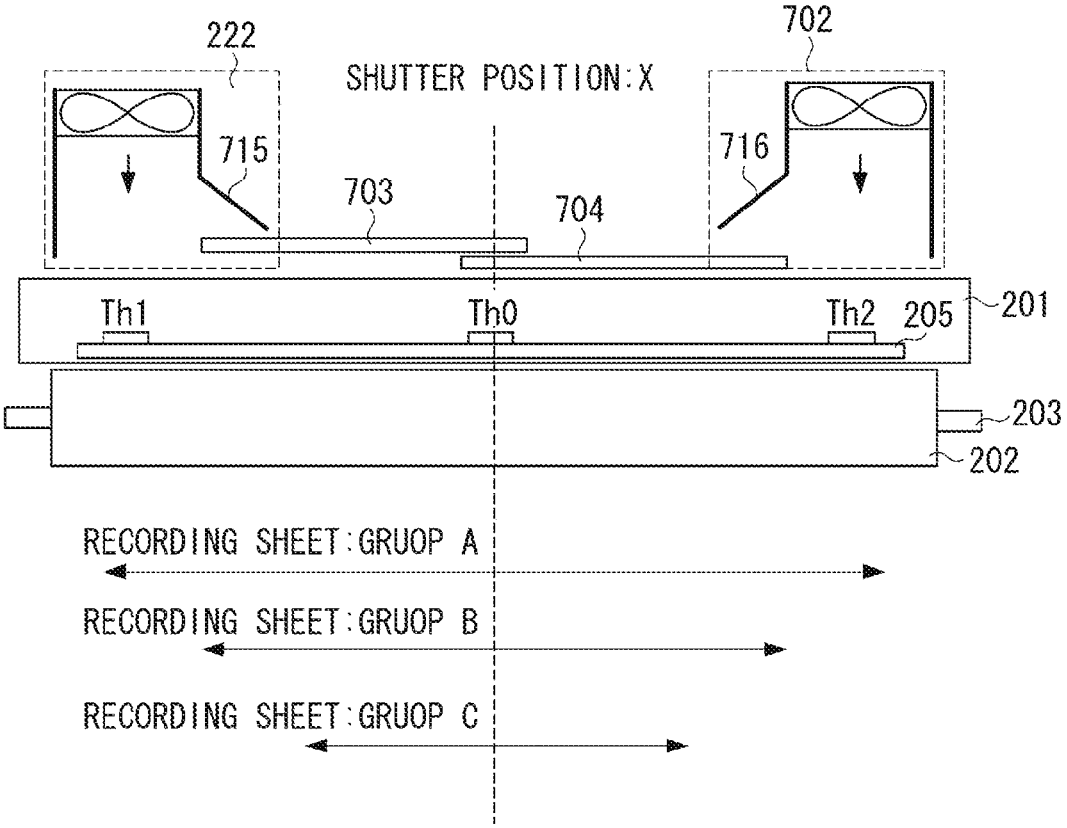
FIG. 7 is a diagram illustrating the relationship between a shutter position X and the width of the recording material according to the first exemplary embodiment.

Next, the construction of a cooling unit mounted in the image forming apparatus will be illustrated with reference to FIG. 7. In the first exemplary embodiment, the cooling unit includes an air supplying fan 222 as a first air supplying member and an air supplying fan 702 as a second air supplying member. Further, the cooling unit includes a shutter 703 as a first shutter and a shutter 704 as a second shutter. The shutter 703 and 704 are movable based on information about the size (width) of the recording material.

Figure 8:
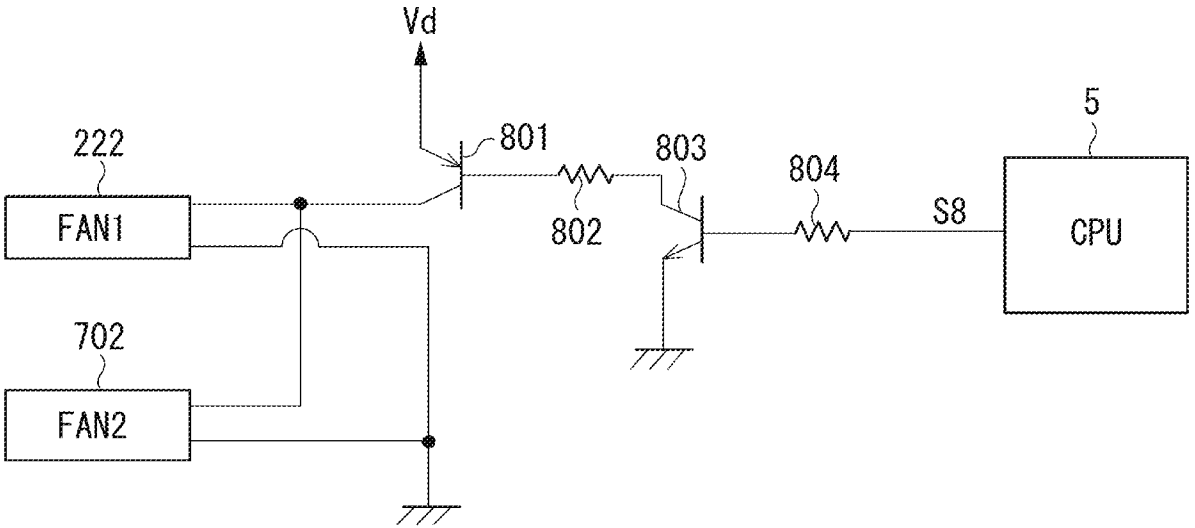
FIG. 8 is a diagram schematically illustrating an air supplying fan operation circuit according to the first exemplary embodiment.

FIG. 8 is an electrical connection diagram of the air supplying fans 222 and 702. In the case where a signal S8 output from the CPU 5 is HIGH, an electric current flows through the base of a transistor 803 via a resistor 804, and the transistor 803 is turned on. Further, the base electric current of a transistor 801 is turned on via a resistor 802, and voltage Vd is applied to the air supplying fans 222 and 702 to operate the air supplying fans. On the other hand, in the case where the signal S8 is LOW, the transistors 803 and 801 are turned off, and the application of voltage to the air supplying fans 222 and 702 is stopped to stop the operation thereof, with the air supplying fans being at rest. The air supplying fans 222 and 702 are operated and stopped simultaneously.

Figure 9:
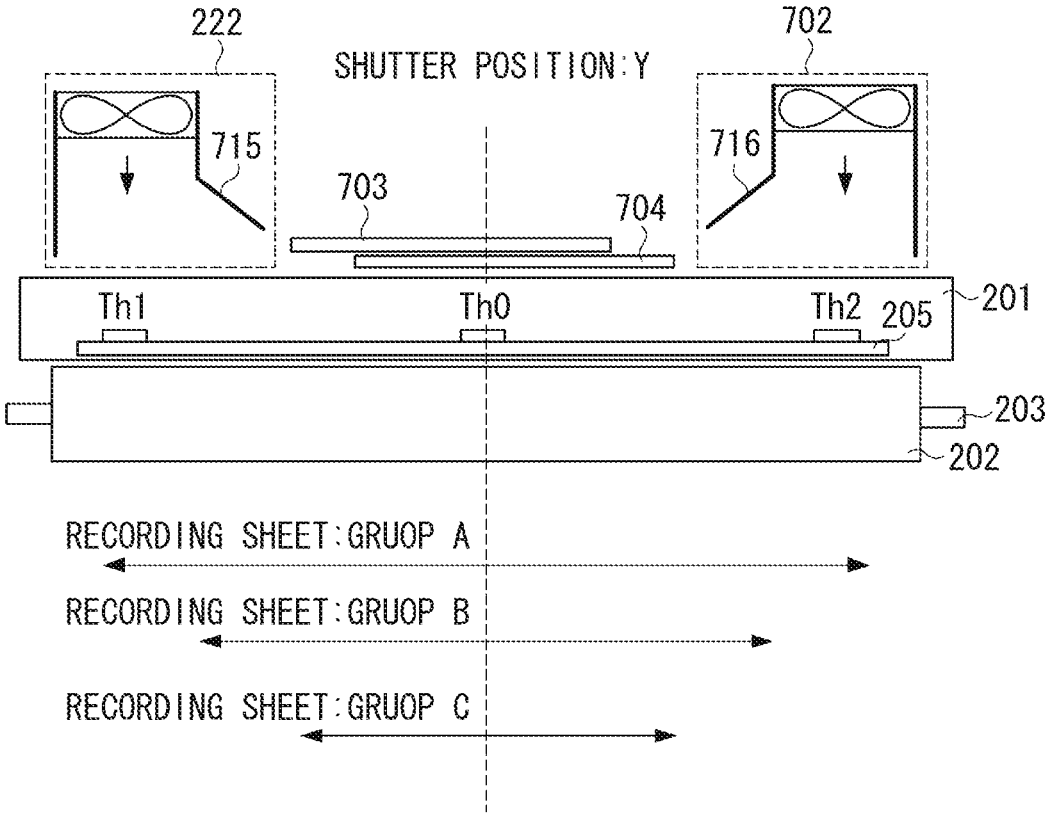
FIG. 9 is a diagram illustrating the relationship among the air supplying fan, a shutter position Y, and the width of the recording material according to the first exemplary embodiment.

Cooling air generated through the operation of the air supplying fans 222 and 702 respectively passes through ducts 715 and 716 to be blown against the film 201. The shutters 703 and 704 are moved by a shutter drive unit (not illustrated). For example, the shutters 703 and 704 move to a position X illustrated in FIG. 7 and to a position Y illustrated in FIG. 9, enabling the air supplying areas to be switched. The position X of FIG. 7 is a shutter position assumed when supplying cooling air to the non-passing areas when passing the recording material of group B. The position Y of FIG. 9 is the shutter position for supplying cooling air to the non-passing areas when passing the recording material of group C. In this way, the shutter position is set according to the width of the recording material in the direction orthogonal to the recording material conveyance direction, whereby it is possible to suppress non-passing part temperature rise.

Next, FIG. 10 illustrates the relationship among the setting of the shutter position, the turning ON/OFF of the air supplying fans, and the width of the recording material. In the first exemplary embodiment, it is always determined to stop the operation of the air supplying fans during the operation of the air supplying fans. The determination to stop the operation is made based on the detection temperatures of the thermistor Th1 and the thermistor Th2 arranged at the end portions of the heater 205 in the direction orthogonal to the recording material conveyance direction. When the absolute value of the difference in detection temperature Δt between the detection temperatures of the thermistor Th1 and the thermistor Th2 becomes larger than a threshold value during the printing operation of the recording material (during its conveyance), the operation of the air supplying fans 222 and 702 is stopped, and the printing operation is continued. The possible reasons for an increase in the above absolute value of the difference Δt during printing operation include the following.

The first possible reason is occurrence of deviated sheet-passing in which the recording material is passed while deviated to either side in the direction orthogonal to the recording material conveyance direction from a conveyance reference position (which, in the first exemplary embodiment, is the center of the heater 205 in the direction orthogonal to the recording material conveyance direction). The second possible reason is imbalance in amount of air supplied to both ends of the film 201 in the direction orthogonal to the recording material conveyance direction due to abnormality in the air supplying fans.

In the case of the first reason, the temperature of the fixing nip N is reduced at the portion (the area J in FIG. 13B) where the recording material is deviated from the conveyance reference position to be allowed to pass the air supplying area, resulting in occurrence of a problem of defective fixing.

Figure 13A:
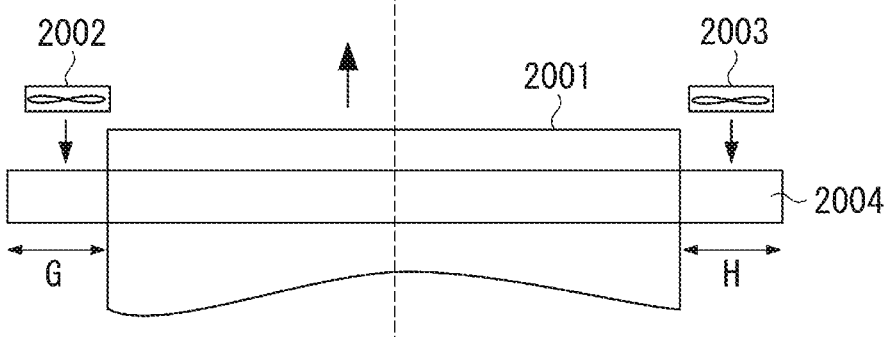
FIG. 13A is a diagram illustrating a film non-passing area and an air supplying area for the air supplying fan in the normal condition.
Figure 13B:
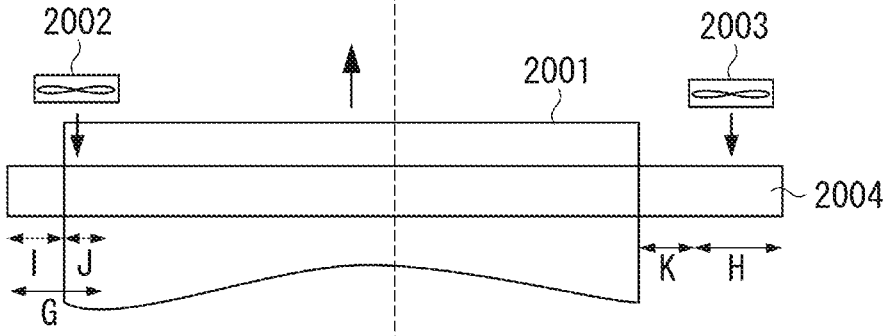
FIG. 13B is a diagram illustrating the film non-passing area and the air supplying area for the air supplying fan at the time of deviated sheet-passing.

Further, a portion, which is supplied with no cooling air despite the portion is an area involving non-passing part temperature rise, is generated, resulting in its temperature rise ratio being higher than in the other areas (the area K in FIG. 13B). Accordingly, when air is supplied by the air supplying fans at the time of generation of deviated sheet-passing, the difference in temperature between the area J and the area K is larger than in the case where no air is supplied. As a result, there is involved a problem common to the second reason in which the difference in temperature between both end portions of the pressure roller 202 in the direction orthogonal to the recording material conveyance direction, and the film 201 is allowed to be deviated, resulting in, in some cases, fracture of the film end portion.

In the first exemplary embodiment, in order to prevent the above-described problem from occurring, when the air supplying fans 222 and 702 are being operated, the operation of the air supplying fans 222 and 702 is stopped according to the absolute value of the above difference Δt, and the printing operation is continued. Here, when the operation of the air supplying fans is stopped, the non-passing part temperature rise may deteriorate if the printing is continued. In view of this, when the detection temperature of at least one of the thermistor Th1 and the thermistor Th2 becomes higher than a threshold temperature, the number of sheets undergoing fixing processing per unit time is reduced as compared with the case where the detection temperatures of both the thermistor Th1 and the thermistor Th2 are lower than the threshold temperature, whereby it is possible to continue the printing operation. Here, what is referred to as the threshold temperature is a temperature determined taking into consideration the withstand temperature of the fixing unit inclusive of the film 201.

Figure 11:
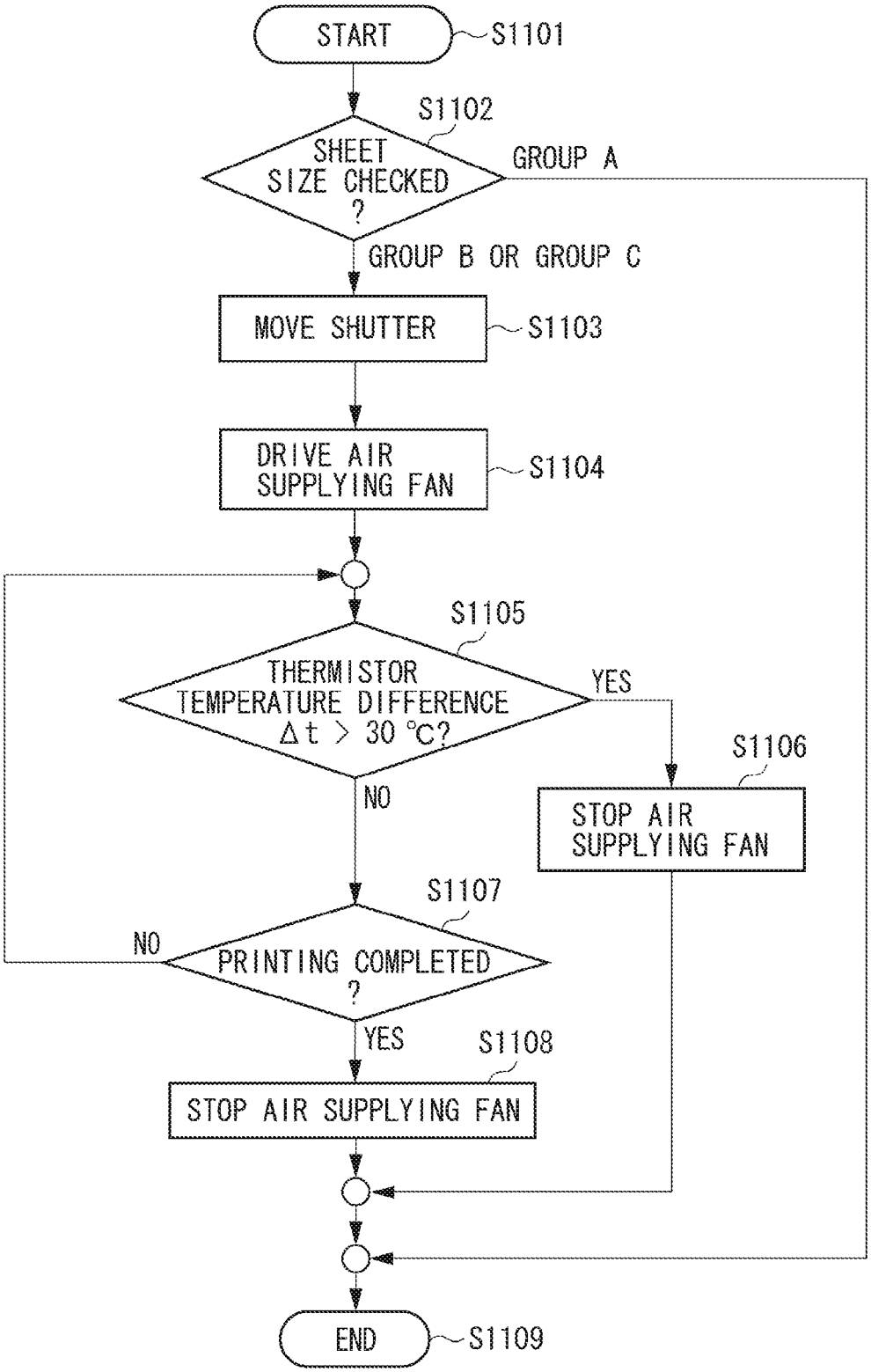
FIG. 11 is a control flowchart for the air supplying fan according to the first exemplary embodiment.

Next, the cooling fan control method will be described. FIG. 11 is a flowchart illustrating a series of air supplying fan control operations during printing operation.

First, in step S1102, the width of the recording material to be printed in the direction orthogonal to the recording material conveyance direction is checked. When the recording material belongs to group A (GROUP A in step S1102), in step S1109, the operation is completed without operating the air supplying fans. On the other hand, when the recording material belongs to group B or C (GROUP B OR GROUP C in step S1102), in step S1103, the shutters 703 and 704 are moved to the positions illustrated in the table of FIG. 10. Subsequently, in step S1104, the air supplying fans 222 and 702 are operated. Next, the detection temperatures of the thermistors are monitored. Specifically, in step S1105, the absolute value of the difference Δt in detection temperature between the thermistors Th1 and Th2 is calculated, and it is checked whether the absolute value is not less than the threshold value (which is 30° C. in the first exemplary embodiment). When the above difference Δt is 30° C. or more (YES in step S1105), in step S1106, the operation of the air supplying fans 222 and 702 is stopped, and the series of procedures are completed. Although not described in the flowchart, after the stopping of the operation of the air supplying fans 222 and 702, when the detection temperature of the thermistor Th1 or Th2 is not less than the threshold temperature, it is possible to reduce the number of sheets per unit time to be subjected to fixing. When the above difference Δt is less than 30° C. (NO in step S1105), in step S1107 it is determined that the printing has been completed, and, in step S1105, the difference Δt is monitored until the completion of the printing. In step S1108, when the printing is completed, the operation of the air supplying fans 222 and 702 is stopped, and the series of procedures are completed.

As described above, in the image forming apparatus according to the first exemplary embodiment, the absolute value of the difference Δt between the thermistors Th1 and Th2 is calculated, and when the value is not less than the threshold value, the operation of the air supplying member is suspended until the completion of the printing.

By performing the above control, even when deviated sheet-passing occurs when air is being supplied to the non-passing areas of the film 201 by the air supplying fans, it is possible to prevent generation of defective fixing at the end portions of the recording material in the direction orthogonal to the recording material conveyance direction, and fracture of the film end portions due to film deviation. Further, even when imbalance in air amount at both end portions of the film 201 in the direction orthogonal to the recording material conveyance direction due to abnormality in the air supplying members occurs, it is possible to prevent fracture of the film end portions due to film deviation.

In the following, a second exemplary embodiment of the present invention will be described. The basic construction of the image forming apparatus according to the second exemplary embodiment is similar to that of the image forming apparatus according to the first exemplary embodiment, but the method for controlling the air supplying members is different. Thus, the following description will center on the difference from the first exemplary embodiment.

Figure 12:
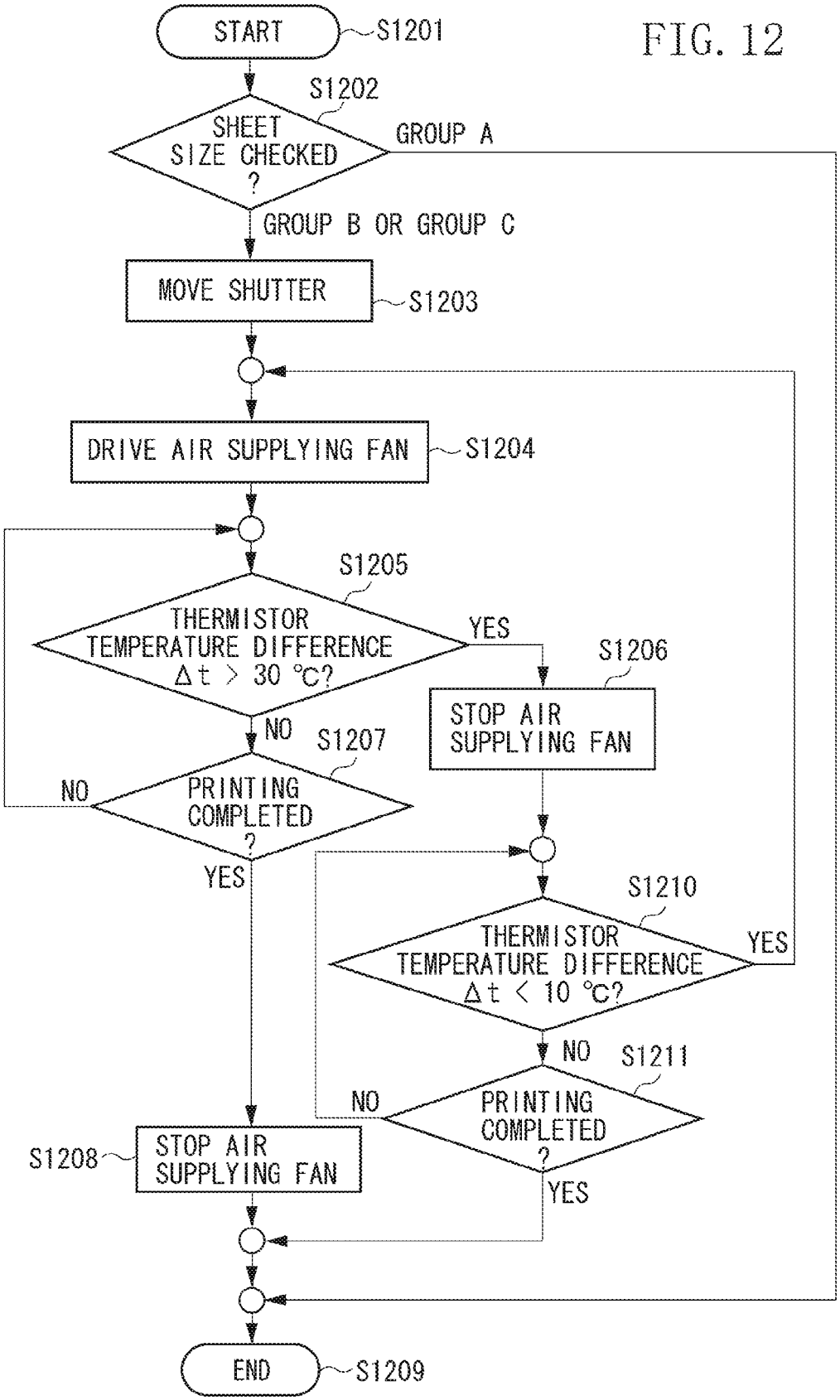
FIG. 12 is a control flowchart for an air supplying fan according to a second exemplary embodiment.

FIG. 12 illustrates a series of control procedures for the air supplying fans during printing operation. The control according to the second exemplary embodiment differs from that according to the first exemplary embodiment in the post-processing when, in step S1205, the absolute value of the difference in temperature Δt between the thermistors Th1 and Th2 becomes not less than the threshold value. The control procedures described in FIGS. 11 and 12 may be implemented in hardware and/or software.

When the absolute value of Δt becomes not less than the threshold value (YES in step S1205), in step S1206 the operation of the air supplying fans is stopped, and, in step S1210, Δt is checked again. When Δt becomes smaller than a second threshold value (10° C.), which is smaller than the above-described threshold value (30° C.), in step S1204, the operation of the air supplying fans is resumed again. On the other hand, when the absolute value of Δt becomes 10° C. or more (NO in step S1210), in step S1210, Δt is monitored until the completion of the printing, with the operation of the air supplying fans being suspended.

After the absolute value of Δt becomes greater than the threshold value (30° C.), and the operation of the air supplying fans is stopped, the absolute value of Δt becomes smaller than the second threshold value (10° C.), which is smaller than the above-described threshold value, the operation of the air-supplying fans is resumed again.

For example, there is a case where recording materials belonging to group B (FIG. 4) are stacked in the cassette 101 (FIG. 1) and recording materials belonging group C are partly mingled therewith. The recording materials of group B are small size recording materials whose size (width) is smaller than that of the recording materials of group A of the maximum size (maximum width) which the apparatus can convey. Accordingly, the shutters 703 and 704 of the air supplying fans 222 and 702 move to the shutter position X to supply air to air supplying areas thus formed.

Here, to be illustrated will be the reason why the recording materials belonging to group C are subject to deviated sheet-passing when recording materials of group C are mingled with the recording materials of group B. Inside the cassette 101 (FIG. 1), a regulation member (not illustrated) regulating a side edge portion of a recording material regulates the movement in the width direction of the recording material of group B. The recording material of group C is of a smaller width than the recording material of group B, so that, within the cassette 101, the recording material of group C can move in the width direction to the regulation member adjusted to the width of the recording material of group B. Thus, when the recording material of group C is conveyed by the pickup roller 104 and the sheet feeding roller 105, the feed is skewed causing sheet-passing to be deviated when the rollers are not aligned properly. When the conveyance of the recording material of group C is completed, and a recording material of group B is conveyed again, the recording material of group B can be conveyed normally without involving any deviated sheet-passing since its movement in the width direction is regulated by the regulation member.

When the recording material of group C undergoes deviated sheet-passing, the absolute value of the difference Δt increases due to the above-described mechanism, and the operation of the air supplying fans 22 and 702 is stopped. In the case where, after the conveyance of the recording material of group C, a recording material of group B is conveyed normally without involving any deviated sheet-passing, the absolute value of Δt decreases.

Further, in some cases, the amount of air supplied by the air supplying fans 222 and 702 becomes temporarily imbalanced, and the absolute value of Δt becomes not less than the threshold value, so that the operation of the air supplying fans is stopped. After this, the air supplying fans are restored to normal, and the absolute value of Δt becomes smaller than the second threshold value (10).

To continue the printing operation with the operation of the air supplying fans being suspended, it is necessary, for example, to reduce the number of sheets per unit time to be subjected to fixing so as to suppress deterioration in non-passing part temperature rise. As a result, the productivity of the apparatus is reduced.

In the case where, as in the second exemplary embodiment, the absolute value of Δt becomes smaller than the second threshold value (10° C.), which is smaller than the above-described threshold value (30° C.), by resuming the operation of the air supplying fans 222 and 702, it is advantageously possible to avoid a reduction in productivity.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-175001 filed Aug. 10, 2011, which is hereby incorporated by reference herein in its entirety.

What is claimed is:

1. An image forming apparatus configured to form an image on a recording material, comprising:

a fixing portion configured to fix the image on the recording material by heating the image while conveying the recording material bearing the image by a nip, a first temperature detection member configured to detect a temperature of one end area of the fixing portion perpendicular to a conveyance direction of the recording material;

a second temperature detection member configured to detect a temperature of the other end area of the fixing portion perpendicular to the conveyance direction; and a cooling portion configured to supply air to the one end area of the fixing portion and the other end area of the fixing portion, wherein the apparatus determines to stop the supplying of air by the cooling portion and to continue a fixing process, depending on a difference value between the detection temperature detected by the first temperature detection member and the detection temperature detected by the second temperature detection member while supplying air by the cooling portion.

2. An image forming apparatus configured to form an image on a recording material, comprising:

a fixing portion configured to fix the image on the recording material by heating the image while conveying the recording material bearing the image by a nip, a first temperature detection member configured to detect a temperature of one end area of the fixing portion perpendicular to a conveyance direction of the recording material;

a second temperature detection member configured to detect a temperature of the other end area of the fixing portion perpendicular to the conveyance direction; and a cooling portion configured to supply air to the one end area of the fixing portion and the other end area of the fixing portion, wherein the image forming apparatus is configured to stop the supplying of air by the cooling portion and to continue a fixing process when a difference value between the detection temperature detected by the first temperature detection member and the detection temperature of detected by the second temperature detection member becomes not less than a threshold value while supplying air by the cooling portion.

3. The image forming apparatus according to claim 2, wherein the image forming apparatus is configured, when the recording material fixing processing is continued with the supplying of air by the cooling portion being stopped, to make the number of recording materials per unit time to be subjected to fixing processing smaller than that when the recording material fixing processing is performed while supplying air by the cooling portion.

4. The image forming apparatus according to claim 2, wherein the image forming apparatus is configured, when at least one of the detection temperature of detected by the first temperature detection member and the detection temperature of detected by the second temperature detection member is higher than a threshold temperature, while the recording material fixing processing is continued with the supplying of air by the cooling unit portion being suspended, to make the number of recording materials per unit time to be subjected to the fixing processing smaller than that when both the detection temperature of detected by the first temperature detection member and the detection temperature of detected by the second temperature detection member are lower than the threshold temperature.

5. The image forming apparatus according to claim 2, wherein the image forming apparatus is configured to resume the supplying of air by the cooling portion when the difference value is smaller than a second threshold value which is smaller than the above-mentioned threshold value, while the recording material fixing processing is continued with the supplying of air by the cooling portion being stopped.

6. The image forming apparatus according to claim 2, wherein the cooling portion includes a first air supplying member configured to supply air to the one end area of the fixing portion, and a second air supplying member configured to supply air to the other end area of the fixing portion.

7. The image forming apparatus according to claim 6, wherein the cooling portion includes a first shutter provided between the first air supplying member and the fixing portion and configured to move so as to adjust an air supplying area for the fixing portion by the first air supplying member according to the width of the recording material, and a second shutter provided between the second air supplying member and the fixing portion and configured to move so as to adjust an air supplying area for the fixing unit by the second air supplying member according to the width of the recording material.

8. The image forming apparatus according to claim 2, wherein the fixing portion includes a tubular film and a back-up member forming the nip between the film and the back-up member.

9. The image forming apparatus according to claim 8, wherein the fixing portion includes a heater which is in contact with an inner surface of the film and forms the nip with the back-up member.

10. The image forming apparatus according to claim 9, wherein the one end portion of the fixing portion and the other end portion of the fixing portion are a non-sheet-passing area of the film.

* * * * *